United States Patent [19]

Northgrave

[11] Patent Number: 4,760,922

[45] Date of Patent: Aug. 2, 1988

[54] COMBINATION PALLET AND COLLAPSIBLE CONTAINER MOUNTED THEREON

[75] Inventor: Randall B. Northgrave, London, Canada

[73] Assignee: International Paper Company Incorporated, Ontario, Canada

[21] Appl. No.: 67,849

[22] Filed: Jun. 30, 1987

[51] Int. Cl.[4] ..... B65D 19/00

[52] U.S. Cl. ..... 206/600; 206/386; 229/23 C; 229/41 R

[58] Field of Search ..... 206/386, 600; 229/41 B, 229/23 R, 23 C, 41 R

[56] References Cited

U.S. PATENT DOCUMENTS

| | | | |
|---|---|---|---|
| 389,367 | 9/1888 | Diemer et al. | 229/183 |
| 1,891,928 | 12/1932 | Hess | 229/183 |
| 2,665,837 | 1/1954 | Guyer | 229/183 |
| 3,119,547 | 1/1964 | Nute . | |
| 4,090,659 | 5/1978 | Galmiche et al. | 229/41 B |
| 4,094,458 | 6/1978 | Nelson, Jr. . | |
| 4,373,637 | 2/1983 | Shippell . | |
| 4,606,461 | 8/1986 | Bolton, Sr. | 229/41 B |

FOREIGN PATENT DOCUMENTS

| | | |
|---|---|---|
| 2102883 | 8/1970 | France . |
| 2328620 | 10/1975 | France . |
| 2480240 | 10/1981 | France . |
| 472044 | 1/1951 | Italy . |

*Primary Examiner*—Jimmy G. Foster

*Attorney, Agent, or Firm*—Walt Thomas Zielinski

[57] ABSTRACT

A pallet and container combination of the type wherein the container is formed from a one-piece corrugated paperboard blank and is attached to the pallet. The container is collapsible and lies flat against the pallet in the knocked down configuration. The container is of the flanged tube type with at least one end of the container, being its bottom end, provided with foldable end flaps, each end flap extending from a respective side wall of the container and joined thereto by a fold defining score line. One of the bottom end flaps, termed a fixing flap, is provided with two score lines defining two fold axes and is stapled to the upper surface of the pallet. After erecting the knocked down container, the remaining three bottom flaps are then likewise stapled to the pallet. The container bottom is partially open. The container is storable in either one of two collapsed configurations, corresponding to the two score lines of the fixing flap. By this construction, a minimum of paperboard is employed, the pallet performing the function of a bottom panel in the erected combination. If desired, the upper end of the tube may also be provided with flaps, providing greater bulge resistance and/or for closing the container.

11 Claims, 5 Drawing Sheets

FIG 2
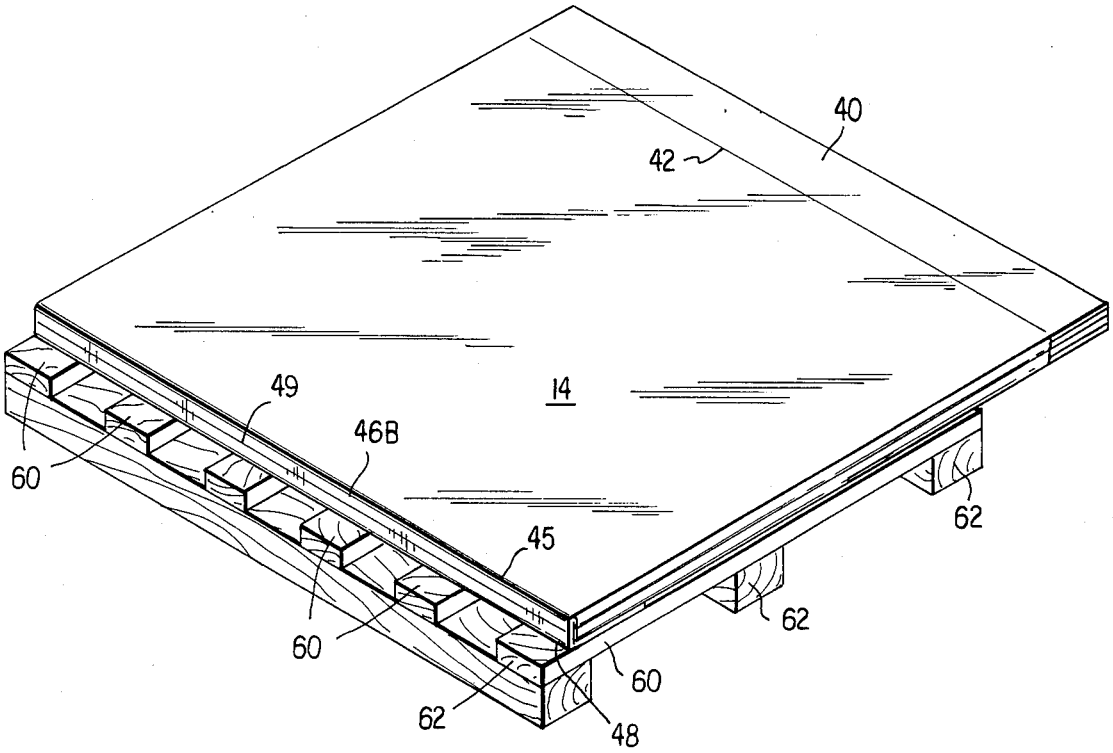
FIG. 3
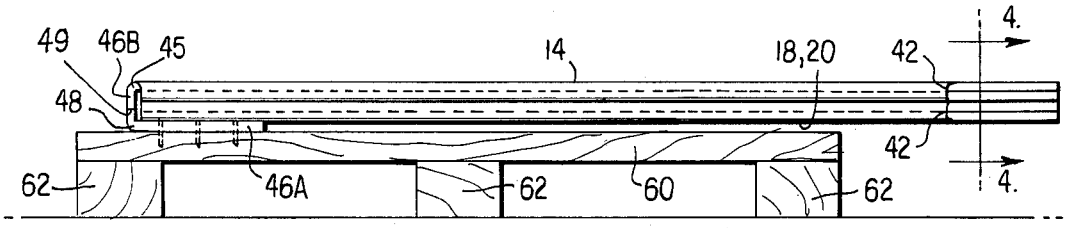
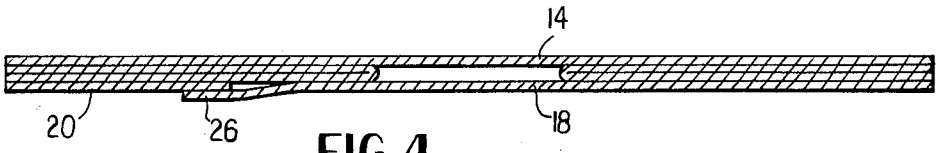
FIG. 4

COMBINATION PALLET AND COLLAPSIBLE CONTAINER MOUNTED THEREON

BACKGROUND OF THE INVENTION

This invention relates to the container art and more specifically to the combination of a pallet and a collapsible paperboard container fixedly mounted thereon.

Various types of containers and pallets for supporting them are currently in use for the shipping of products. The most common type of container used in the pallet industry is a flanged tube affixed to the pallet. A flanged tube is a four sided container with a short flap (being the flange) attached, usually at both tube ends, to each of the four container sides. This flap can vary in dimension but is usually in the 4–6 inch range. The top flap, although providing closure capability and bulge resistance to the container, is not necessary and may or may not be included. The bottom flange or flap serves several purposes. When the container is in its erected or set-up state, this flange is parallel to and resting upon the pallet and is at right angles to the side walls of the container. This flange provides a means whereby the container is affixed to the pallet, and also provides greater bulge resistance for the outside walls of the container when the container is filled. Perhaps one of the major reasons this type of container has received such acceptance in the industry is that the flanged tube design, as opposed to a container with a full bottom or floor, requires much less material to manufacture and thus provides a more economical pack that can perform the same function. Since these containers are costly and usually used only once, cost is a major factor.

Although the flanged tube design has many desirable features, there are some drawbacks associated with this design. The main drawback is that once the container is assembled, the container takes up a large amount of space for storage and shipping of empty containers. Because of this storage problem, containers usually have to be totally assembled as required for end use, thus allowing little advance manufacturing, and preventing a smooth flow for production and production scheduling. Shipping of set up pallet boxes is thus limited to small quantities even when using very large trucks for their transport.

The container art is aware of pallet and container constructions wherein the container is collapsible for storage, as shown in U.S. Pat. No. 4,373,637 issued to Shippell, corresponding to Canadian Patent No. 1,193,987.

SUMMARY OF THE INVENTION

It is the purpose of this invention to provide a pallet box that allows partial assembly, prior to final set up, with a knock down feature for storage and shipping, utilizing the beneficial features of a flanged tube design. The box may be stored in either of two configurations.

According to the practice of this invention, a novel pallet and collapsible container is provided which minimizes the amount of paperboard required for the container and which requires a minimum of storage space when the container is collapsed.

BRIEF DESCRIPTION OF THE DRAWINGS

FIG. 2 is a perspective view of the combination pallet and collapsible container of this invention and illustrates the container in its collapsed condition.

FIG. 3 is a side elevational view of FIG. 2.

FIG. 4 is a view taken along section 4—4 of FIG. 3.

DETAILED DESCRIPTION OF THE INVENTION

Figure 1:
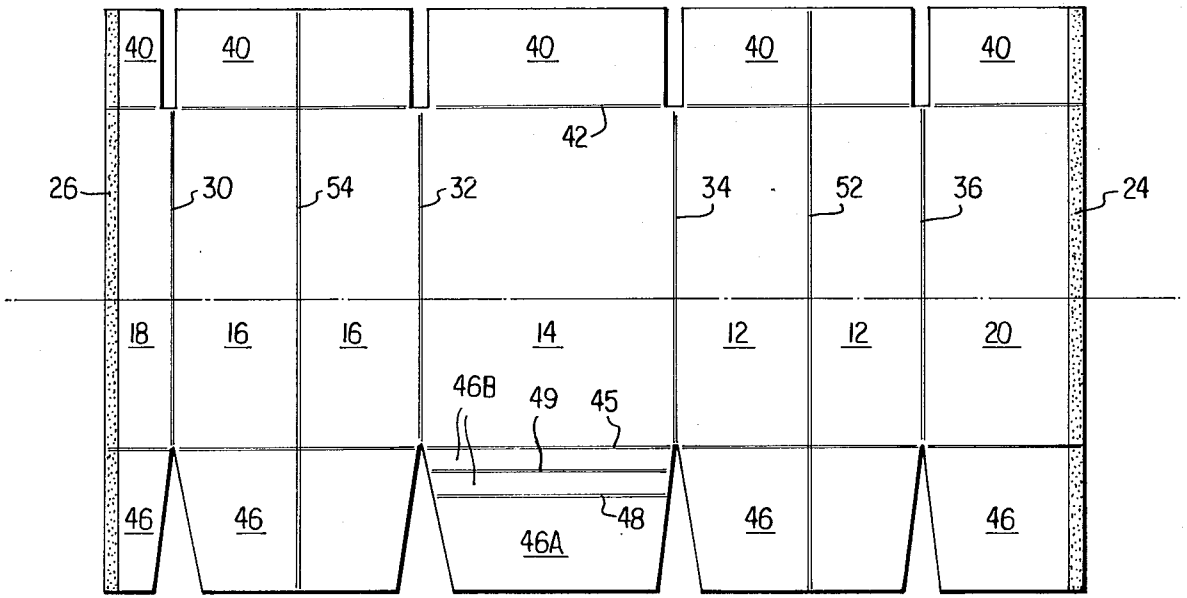
FIG. 1 is a plan view of a paperboard blank from which the collapsible container is formed.

Referring now to FIG. 1 of the drawings, the numeral 10 denotes generally a paperboard blank, typically of corrugated paperboard or other stiff, foldable, and resilient sheet material. The blank is formed from a plurality of hinged side panels, serially arranged along a longitudinal axis of the blank, the side panels being denoted by the numerals 12, 14, 16, 18, and 20. The edges of panels 18 and 20 are shaded, as indicated by the numerals 24 and 26, with these latter areas adapted to be overlapped and stapled together or secured by an adhesive to thereby form a flanged tube type container. The numeral 40 denotes each of a series of top flaps at one end of the tube, with each of these top flaps having a fold defining score line 42 generally parallel to the indicated longitudinal axis of the blank. Similarly, the bottom end of the blank, as viewed at FIG. 1, is provided with a plurality of bottom flaps 46, depending from score line 45, also foldably and integrally secured to respective edges of the main panels 12–20, in a manner similar to flaps 40, with numeral 48 denoting a score line in one of these lower flaps 46, to divide it into zones 46A and 46B. Score line 48 is located between fold defining score line 45 and the free end of flap 46A, 46B, this flap termed a fixing flap. That portion or zone denoted by the numeral 46B is termed a connecting distance portion. Each bottom flap is tapered towards its free or lower end to thereby relieve stress at the junctions of the tapered edges when the blank is folded. For a purpose which will later be explained, an additional score line 49 is provided, located essentially midway of fold lines 45 and 48.

The numerals 30, 32, 34, and 36 denote vertically extending score or hinge lines, as viewed in FIG. 1, between and defining the several side panels. The numerals 52 and 54 denote a score line running the entire top to bottom length of, respectively, panels 12 and 16 and their corresponding flaps.

The blank shown at FIG. 1 folded along either lines 30 and 34 or 32 and 36, and zones 24 and 26 then secured together as by staples or an adhesive to form a tube. The bottom flap containing score line 48, being bottom flap 46A, 46B, termed the fixing flap, is then stapled to the pallet 59 by portion 46A, adjacent one end of each of upper wooden strips 60 of the pallet, the latter also having lower wooden strips 62. The pallet may also be of the four way entry style, as well as the style illustrated. Further, the pallet need not be fashioned from wood. As shown at FIGS. 2 and 3, flap portion 46A is spaced inwardly from edges of strips 60 of the wooden pallet by a distance corresponding to the length of flap portion 46B, as measured vertically in FIG. 1. This is the distance between score lines 48 and 45. The remaining flaps 46 are swung upwardly to a stored position against the interior surfaces of their respective side panel walls.

The container is then caused to assume a flattened condition, having been flattened by folding along fold lines 52 and 54, as shown at FIGS. 2 and 3. Fixing flap portion 46B is parallel to the pallet 59.

The pallet and container may now be stored until final assembly is required, or shipped to the end user where it can then be stored until final assembly is required or shipped in this knocked-down state for immediate set-up, final assembly, and use.

Figure 6:
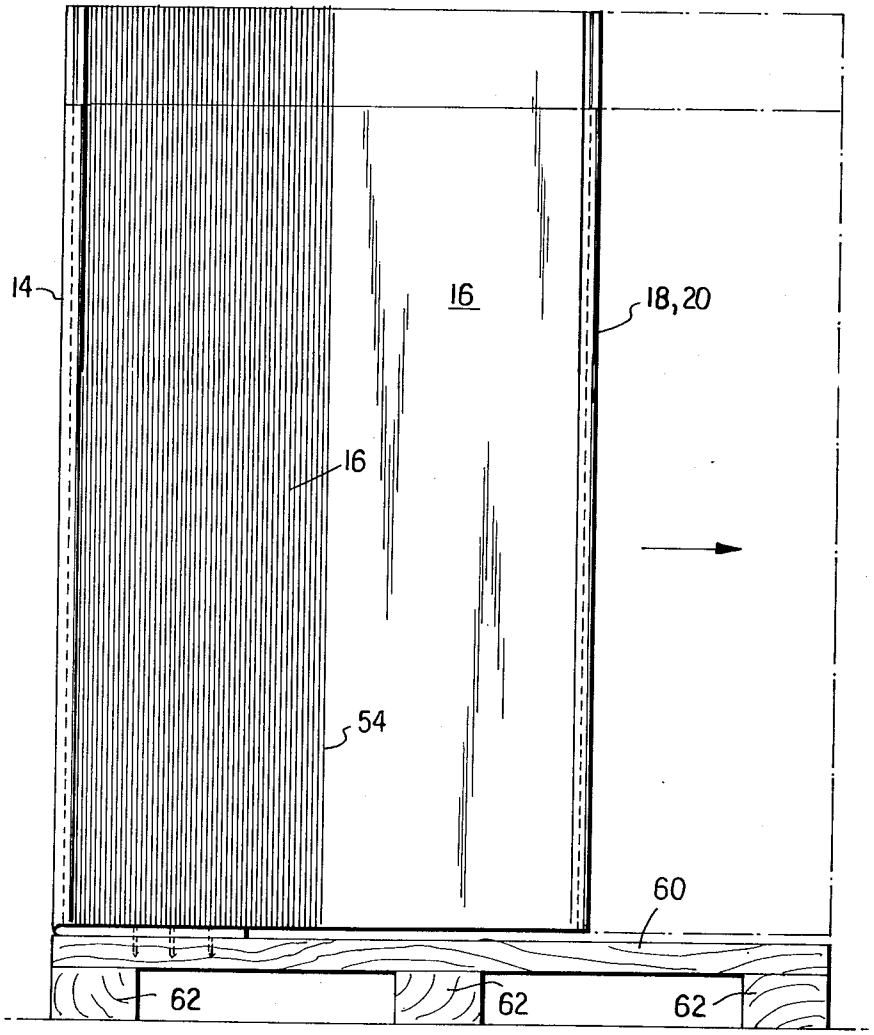
FIG. 6 illustrates a partially open configuration in the erection of the container.
Figure 5:
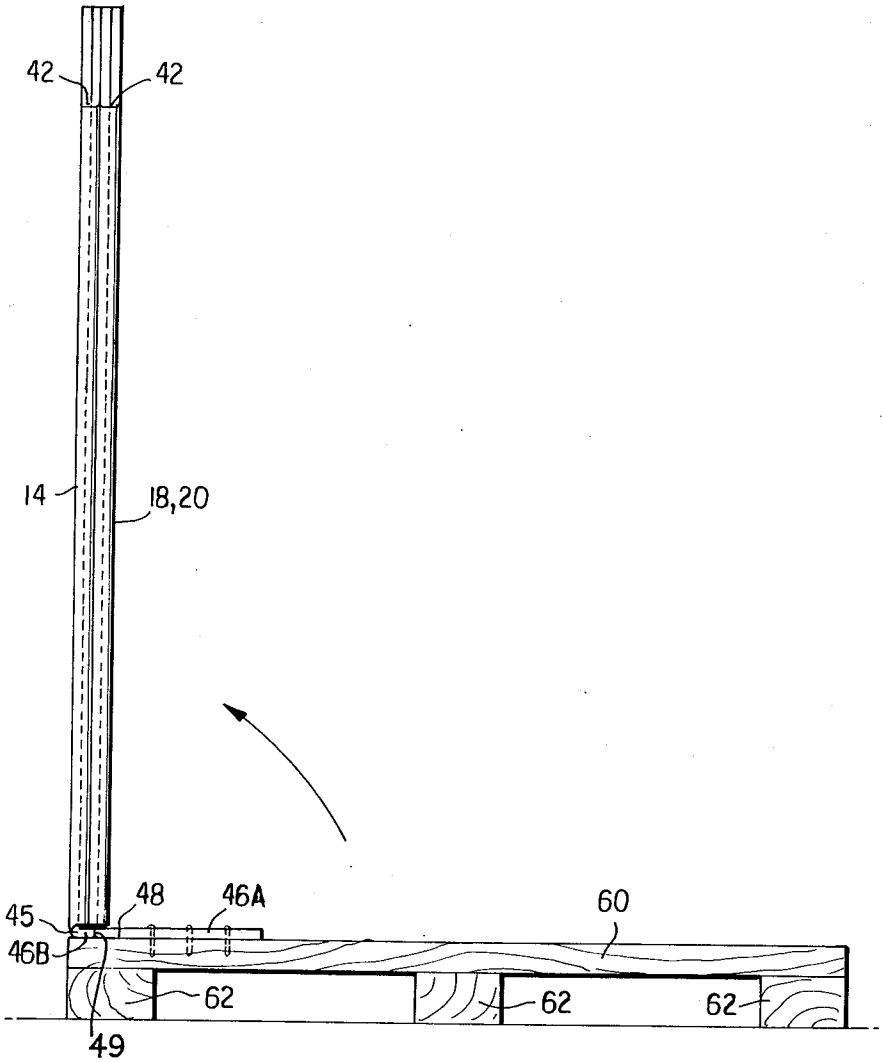
FIG. 5 illustrates a first step in erecting the container, the view being shown from the same point as FIG. 3.
Figure 8:
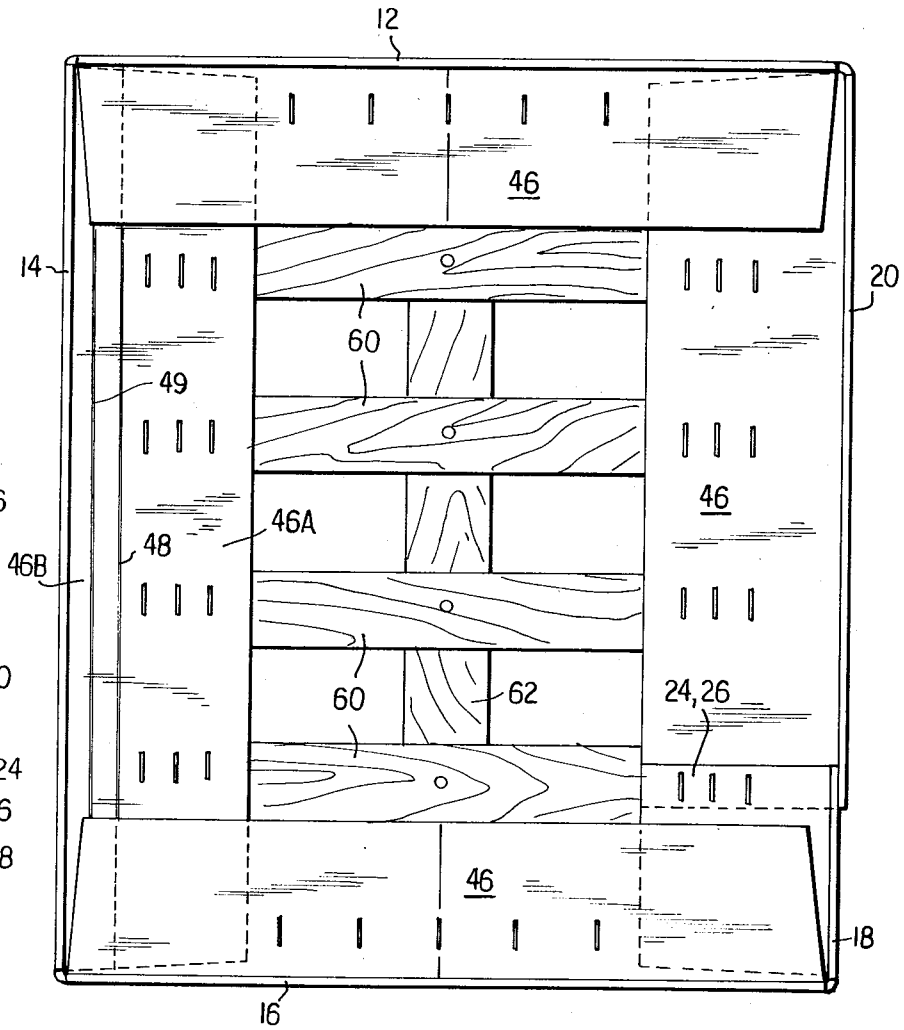
FIG. 8 is a view similar to FIG. 7, and illustrates the final configuration of the fully erected container and pallet combination of this invention.
Figure 7:
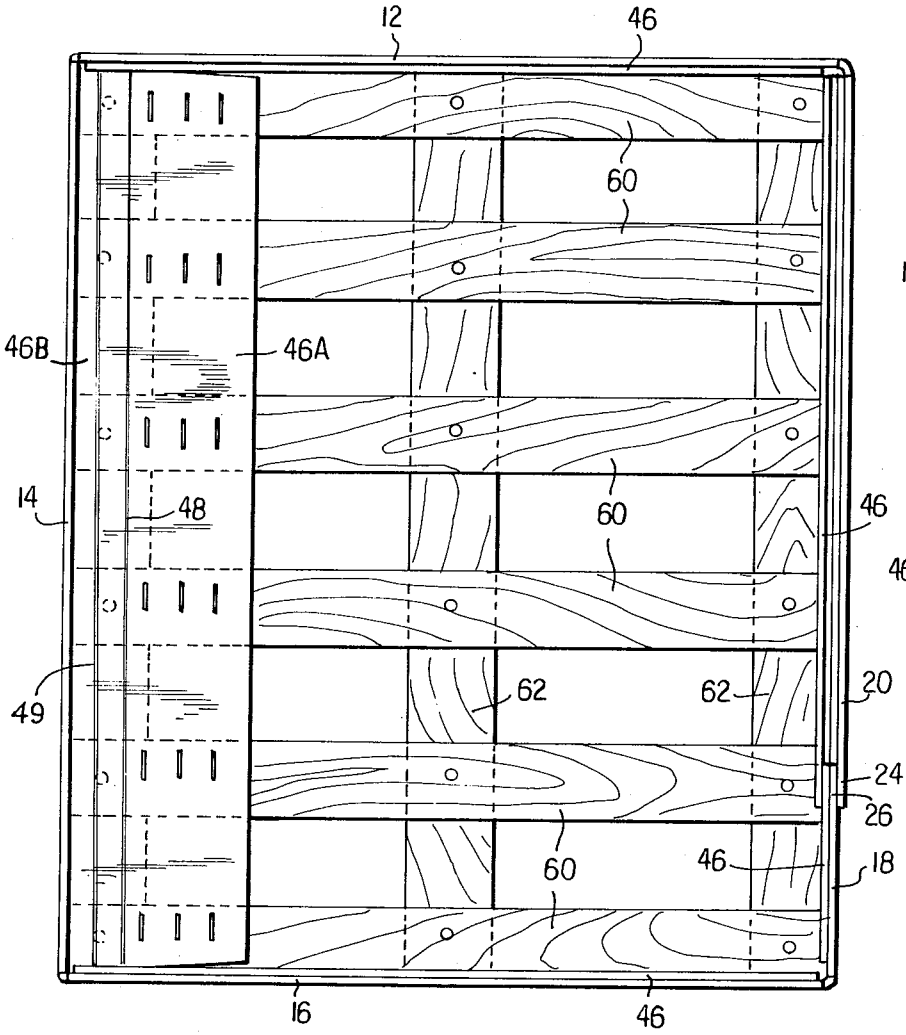
FIG. 7 is a top view of the combination pallet and container after the container has been fully opened.

To effect setting up or erection of the container, the collapsed pallet shown at FIGS. 2 and 3 is swung in the direction indicated by the curved arrow at FIG. 5 until the container is in a substantially vertical configuration. Then, the right hand panel 18,20 of the collapsed container, as viewed in FIG. 5, is moved away from the left hand panel 14, to a fully open configuration. FIG. 6 indicates a partially open configuration indicating this motion. The motion indicated by the straight arrow at FIG. 6 continues until the configuration illustrated at FIG. 7 is reached, at which time the tube walls or panels are in their fully expanded condition. Then, the three remaining lower end flaps 46 are swung downwardly from their stored position, flat against the inside of their respective tube panels, so as now to lie flat on the upper surface of the pallet. These remaining three end flaps are now stapled or are otherwise secured to the pallet, as indicated at FIG. 8. The pallet is now fully open and ready for use, as by filling it, such as with bulk products. It will be observed from FIG. 8 that the length of each bottom flap 46 is such that the free ends of opposite pairs of these flaps are spaced from each other, to thus create a partially open bottom.

It will be understood that the blank shown at FIG. 1 need not be provided with the upper flaps 40, these flaps serving merely to close the open container on the top, and/or to add greater bulge resistance, if desired. It will further be understood that the score line 48 on the flap 46A, 46B may be extended to all flaps 46, it being only necessary that this score line be provided for bottom end or fixing flap 46A, 46B. As shown at FIG. 1, the end flaps 46 are tapered, to thereby inhibit binding upon folding and to reduce stress at the junction of the fold lines 30, 32, 34, 36 with score line 45.

Upper flaps 40 are folded inwardly so to assume a horizontal configuration and may be secured together at their overlapped ends, as by staples. Such joining of the ends of the flaps 40 adds rigidity to the container and hence increases its bulge resistance. Further, these flaps provide horizontal surfaces to facilitate stacking. If desired, corner posts may be added to thereby strengthen the erected container and to increase its stacking strength.

Figure 9:
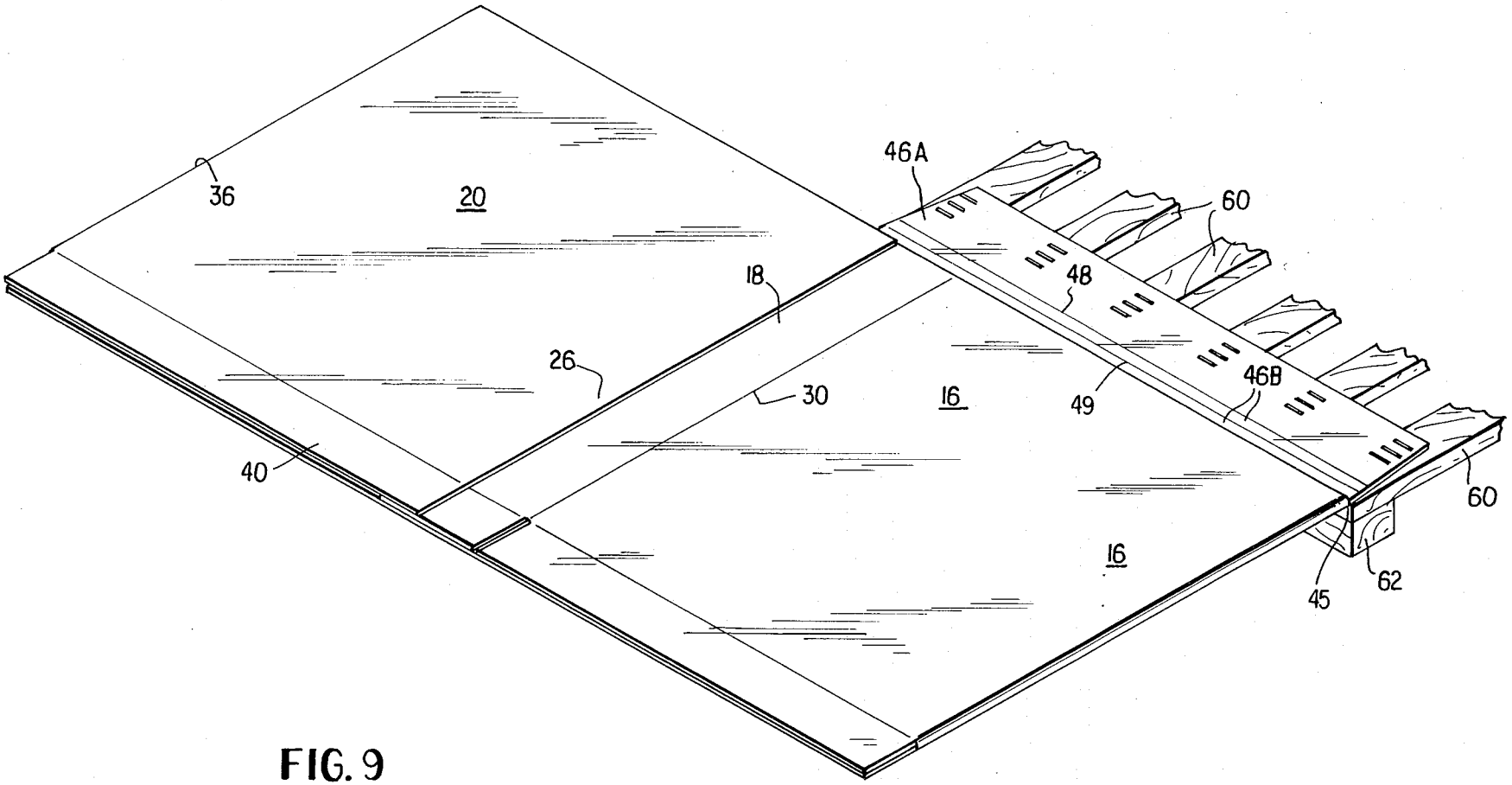
FIG. 9 illustrates an alternative mode of storing the collapsed tube tyupe container formed from the one piece blank of FIG. 1.

Referring now to FIG. 9, a slightly modified form of the invention is illustrated. After joining the edge areas 24 and 26 of the blank, each bottom end flap 46, except fixing flap 46A, 46B, is folded towards the indicated longitudinal axis of the blank. Thus only the fixing flap extends beyond score line 45 of the blank. The fixing flap is now secured, as by staples or adhesive, to the top of the pallet as indicated at FIG. 9. From this position, the flattened container is rotated 180 degrees, clockwise, to lie on top of the pallet, the folding being about axes 45 and 48, with section 46B again being at right angles to the pallet. The resulting stored configuration is similar to that shown in FIGS. 2 and 3. For this embodiment, fold lines 52 and 54 are not required. Further, the width of section 46B need be only at least three times the thickness of the blank sheet material, instead of at least six tims as with the first described embodiment of FIGS. 1 to 8. Container erection is effected by rotating the collapsed container 90 degrees counterclockwise, opening the container, and then securing the remaining bottom flaps 46 to the pallet as previously described.

The essential difference between the storage configuration of FIG. 2 and that of the embodiment of FIG. 9 is that the thickest part of the collapsed and stored container of the FIG. 2 configuration (left portion of FIG. 3) has eight layers of the sheet material, i.e., paperboard, while the thickest portion of the FIG. 9 collapsed and stored container is of four layers of the sheet material. Thus, although occupying a greater horizontal area as regards floor space, the storage configuration is thinner. In order to provide a container which may be stored in either the collapsed configuration of FIG. 2 or that indicated in FIG. 9, the blank shown at FIG. 1 is provided with a second score line 49 on portion 46B to thereby define a second fold axis. When the container is stored in the configuration shown at FIG. 2, fold axis 48 is used and fold axis 49 is not employed. When the container is stored according to the second embodiment of this invention, fold axis 49 is employed and fold axis 48 is not used. In both cases, the portion 46B is normal to the plane of the pallet in the stored configuration, as shown at FIG. 2. In one case, its height is at least equal to three thicknesses of the sheet material and in the other case, equal to at least six thicknesses. In order to permit the invention to be employed in either of the two described modes, the score lines 52 and 54 are provided, even though they are not used with the second manner of folding for storage.

French Patents Nos. 2,102,883 and 2,328,620, and 2,480,240 also describe somewhat similar constructions.

French Patent No. 2,102,883 has a full bottom and thus more material is required for its manufacture. Further, it has a cap that covers the assembly, including pallet and container, and is thus restricted in size. No such restriction applies to this invention. Still further, this French patent construction includes a horizontal score line 5, as shown in FIG. 2, as well as corner slots which will weaken the overall structural strength. These slots extend vertically at the container corners between the pallet and score line 5.

French Patent No. 2,102,883 also uses a Z fold that requires a 180 degree fold in two areas that will weaken the material in these areas. The present invention uses two 90 degree folds and thus provides less stress at these scores. Further yet, the French patent has infolds on the long sides of the container, creating an overlap of material while in the knockdown state and thus creates a more bulky pack.

French Patent No. 2,328,620 has a full bottom and thus more material is required to manufacture it. Further, it has a cap that covers the assembly, including pallet and container, and is thus restricted in size. No such restriction applies to the present construction. Further, this patent uses a Z fold that requires a 180 degree fold in two areas that will weaken the material in these areas. The present construction uses two 90 degree folds and thus provides less stress at these scores. Further, it has infolds on the long sides of the container creating an overlap of material while in the knockdown state, and thus creates a more bulky pack.

French Patent No. 2,480,240 requires a full bottom and thus more material is required for its manufacture. Further, this patent has a cap that covers the assembly, including pallet and container, and is thus restricted in size. No such restriction applies to the construction of the present invention. Further, it uses a Z fold that requires a 180 degree fold in two areas that will weaken the material in these areas. The present construction uses two 90 degree folds and thus provides less stress at these scores. Further, it requires total assembly prior to final set-up. The present construction permits partial assembly prior to final set-up. Further, this French construction folds end flaps inside and thus creates binding or stress at the side scores. The present construction uses tapered flaps to reduce this stress.

The noted Shippell construction requires a full bottom and thus more material is required to manufacture it. Further, Shippell uses a Z fold that requires a 180 degree fold in two areas that will weaken the material in these areas. The present construction uses two 90 degree folds and thus provides less stress at these scores. Shippell further requires total assembly prior to final set-up. The present construction permits partial assembly prior to final set-up. Further, Shippell folds end flaps inside and thus creates binding or stress at the side scores. The present construciton uses tapered flaps to reduce this stress.

What is claimed is:

1. A pallet and a tube type container construction of the type wherein the container is rectangular and is collapsed onto said pallet in a flattened configuration parallel with the pallet, the container being of the flanged tube type and fashioned from a one piece blank of stiff, resilient and bendable sheet material, such as corrugated paperboard, one end of the tube being provided with a plurality of bottom flaps each having a free end and another end foldably and integrally connected to a respective side panel wall of said container, one of said bottom flaps, termed a fixing flap, having a first score line between the foldable connection joining said fixing flap to its respective side panel wall and its free end, said fixing flap being affixed to an upper surface portion of said pallet, at that area of said fixing flap which is between its free end and said first score line, each bottom flap being of a length such that the free ends of each of the opposite pairs of bottom flaps are spaced from each other, to thereby define a partially open container bottom when the tube type container is erected from its collapsed configuration, whereby the amount of sheet material is reduced, that portion of said fixing flap between (1) said first score line and (2) the junction of said fixing flap with its respective side panel wall being termed a connecting distance portion, wherein that side panel wall opposed to said side panel wall which carries said fixing flap rests in surface contact with a surface of said fixing flap, and wherein said connecting distance portion is substantially perpendicular to said fixing flap.

2. The pallet and container construction of claim 1 wherein the remaining bottom flaps, being those other than said fixing flap, are each bent so as to lie interiorly of said container and flat against its respective side panel wall.

3. The pallet and container construction of claim 1 wherein the other end of said tube is provided with a plurality of top flaps each having a free end and another end foldably and integrally connected to a respective side panel wall of said container.

4. A pallet and a tube type container construction of the type wherein the container is rectangular and is collapsible to a flattened configuration parallel with the pallet, the container being of the flanged tube type and fashioned from a one piece blank of stiff, resilient and bendable sheet material, such as corrugated paperboard, one end of the tube being provided with a plurality of bottom flaps each having a free end and another end foldably and integrally connected to a respective side panel wall of said container, one of said bottom flaps, termed a fixing flap, having a first score line between the foldable connection joining said fixing flap to its respective side panel wall and its free end, said fixing flap being affixed to an upper surface portion of said pallet, at that area of said fixing flap which is between its free end and said first score line, each bottom flap being of a length such that the free ends of each of the opposite pairs of bottom flaps are spaced from each other, to thereby define a partially open container bottom when the tube type container is erected from its collapsed configuration, whereby the amount of sheet material is reduced, the distance between (1) said first score line and (2) the junction of said fixing flap with its respective side panel wall being substantially equal to three thicknesses of said sheet material, whereby said container is foldable to a storage configuration.

5. The pallet and container construction of claim 4, wherein, when said container is collapsed, the remaining bottom flaps, being those other than said fixing flap, are each bent so as to lie interiorly of said container and flat against its respective side panel wall.

6. The pallet and container construction of claim 4, wherein the other end of said tube is provided with a plurality of top flaps each having a free end and another end foldably and integrally connected to a respective side panel wall of said container.

7. A pallet and a tube type container construction of the type wherein the container is rectangular and is collapsible to a flattened configuration parallel with the pallet, the container being of the flanged tube type and fashioned from a one piece blank of stiff, resilient and bendable sheet material, such as corrugated paperboard, one end of the tube being provided with a plurality of bottom flaps each having a free end and another end foldably and integrally connected to a respective side panel wall of said container, one of said bottom flaps, termed a fixing flap, having a first score line between the foldable connection joining said fixing flap to its respective side panel wall and its free end, said fixing flap being affixed to an upper surface portion of said pallet, at that area of said fixing flap which is between its free end and said first score line, each bottom flap being of a length such that the free ends of each of the opposite pairs of bottom flaps are spaced from each other, to thereby define a partially open container bottom when the tube type container is erected from its collapsed configuration, whereby the amount of sheet material is reduced, the distance between (1) said first score line and (2) the junction of said fixing flap with its respective side panel wall being substantially equal to six thicknesses of said sheet material, whereby said container is foldable to a storage configuration.

8. A pallet and a tube type container construction of the type wherein the container is rectangular and is collapsible to a flattened configuration parallel with the pallet, the container being of the flanged tube type and fashioned from a one piece blank of stiff, resilient and bendable sheet material, such as corrugated paperboard, one end of the tube being provided with a plurality of bottom flaps each having a free end and another end foldably and integrally connected to a respective side panel wall of said container, one of said bottom flaps, termed a fixing flap, having a first score line between the foldable connection joining said fixing flap to its respective side panel wall and its free end, said fixing flap being affixed to an upper surface portion of said pallet, at that area of said fixing flap which is between its free end and said first score line, each bottom flap being of a length such that the free ends of each of the opposite pairs of bottom flaps are spaced from each other, to thereby define a partially open container bottom when the tube type container is erected from its collapsed configuration, whereby the amount of sheet material is reduced, the distance between (1) said first score line and (2) the junction of said fixing flap with its respective side panel wall being at least equal to six thicknesses of said sheet material, whereby said container is foldable to a storage configuration, and including a second score line on said fixing flap, parallel to said first score line on said fixing flap, said second score line being spaced from the junction of said fixing flap with its respective side panel wall by a distance at least equal to three thicknesses of said sheet material, whereby the container can be folded in either of two configurations.

9. The pallet and container construction of claim 8 wherein, when said container is collapsed, the remaining bottom flaps, being those other than said fixing flap, are each bent so as to lie interiorly of said container and flat against its respective side panel wall.

10. The pallet and container construction of claim 8 wherein the other end of said tube is provided with a plurality of top flaps each having a free end and another end foldably and integrally connected to a respective side panel wall of said container.

11. A pallet and a tube type container construction of the type wherein the container is rectangular and is collapsible to a flattened configuration parallel with the pallet, the container being of the flanged tube type and fashioned from a one piece blank of stiff, resilient and bendable sheet material, such as corrugated paperboard, one end of the tube being provided with a plurality of bottom flaps each having a free end and another end foldably and integrally connected to a respective side panel wall of said container, one of said bottom flaps, termed a fixing flap, having a first score line between the foldable connection joining said fixing flap to its respective side panel wall and its free end, said fixing flap being affixed to an upper surface portion of said pallet, at that area of said fixing flap which is between its free end and said first score line, each bottom flap being of a length such that the free ends of each of the opposite pairs of bottom flaps are spaced from each other, to thereby define a partially open container bottom when the tube type container is erected from its collapsed configuration, whereby the amount of sheet material is reduced, each bottom flap being tapered towards its free end to thereby inhibit binding upon folding and to reduce stress, the distance between (1) said first score line and (2) the junction of said fixing flap with its respective side panel wall being at least equal to three thicknesses of said sheet material, whereby said container is foldable to a storage configuration.

* * * * *